United States Patent [19]

Radcliffe

[11] Patent Number: 4,854,489

[45] Date of Patent: Aug. 8, 1989

[54] GARMENT HANGER

[75] Inventor: Anthony E. Radcliffe, Chorley, United Kingdom

[73] Assignee: Pendy Plastic Products Limited, United Kingdom

[21] Appl. No.: 117,284

[22] Filed: Nov. 4, 1987

[51] Int. Cl.[4] ..... A47G 25/44; A47G 25/62

[52] U.S. Cl. ..... 223/95

[58] Field of Search ..... 223/95, 94, 61, 63, 223/96, 89, 90

[56] References Cited

U.S. PATENT DOCUMENTS

| | | | |
|---|---|---|---|
| 2,170,686 | 8/1939 | Isaacson | 223/95 |
| 2,496,561 | 2/1950 | Saunders . | |
| 3,632,028 | 1/1972 | Fussel | 223/95 |
| 4,729,498 | 3/1988 | Blanchard | 223/95 |

FOREIGN PATENT DOCUMENTS

| | | | |
|---|---|---|---|
| 1753615 | 11/1971 | Fed. Rep. of Germany . | |
| 3530380 | 4/1986 | Fed. Rep. of Germany | 223/95 |
| 1395767 | 3/1965 | France | 223/95 |
| 1087483 | 10/1967 | United Kingdom . | |
| 1170506 | 11/1969 | United Kingdom . | |
| 1175616 | 12/1969 | United Kingdom . | |
| 1189093 | 4/1970 | United Kingdom . | |
| 1258871 | 12/1971 | United Kingdom . | |
| 1340999 | 12/1973 | United Kingdom . | |
| 2012581 | 8/1979 | United Kingdom . | |
| 2018584 | 10/1979 | United Kingdom . | |
| 2021402 | 12/1979 | United Kingdom . | |
| 1564678 | 4/1980 | United Kingdom . | |
| 2120542 | 12/1983 | United Kingdom . | |
| 2128079 | 4/1984 | United Kingdom . | |

*Primary Examiner*—Robert R. Mackey

*Attorney, Agent, or Firm*—Silverman, Cass, Singer & Winburn, Ltd.

[57] ABSTRACT

A garment hanger is provided comprising a middle section with a hanging member such as a hook mounted thereon and two end sections with means for engaging a garment. At least one of the end sections is arranged for sliding movement relative to the middle section between a retracted position and an extended position. In particular, the end section may be telescopically mounted within the middle section. The end section is urged towards the extended position by an elastomeric band. In one aspect of the invention, the elastomeric band, when in the retracted position of the end section, is longer than the length of overlap between the said end section and the middle section. In another aspect of the invention, the band is trained in a path such that, as it stretches, an increasing proportion of the material of the band extends between the end section and the middle section to urge those sections apart.

10 Claims, 6 Drawing Sheets

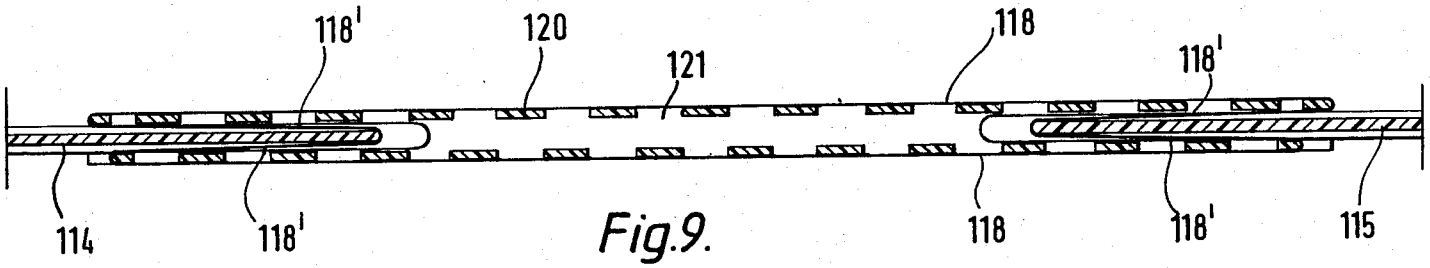
Fig.9.
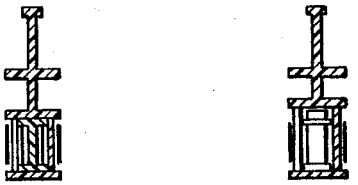
Fig.10a.
Fig.10b.
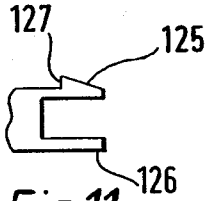
Fig.11.

GARMENT HANGER

BACKGROUND OF THE INVENTION

This invention relates to a garment hanger, and in particular to a hanger of the type comprising a middle section with a hanging member such as a hook mounted thereon and two end sections with means for engaging a garment, at least one of the end sections being arranged for sliding movement relative to the middle section between a retracted position and an extended position, and being biased towards the extended position.

Known hangers of this type generally employ a compression spring to urge the or each end section to the extended position. Examples of such hangers are found in UK patent applications published as Nos. 2021402A and 2120542A.

Hangers employing springs such as are known in the art suffer from a number of disadvantages. Foremost of these is their expense. Steel springs on their own are expensive in comparison with the relatively cheap plastic parts of the hanger. Moreover, they are notoriously difficult to handle when loose. For example, they tend to tangle with each other, and it is difficult to load the springs on a machine in a manner that will enable the springs to be presented to a hollow middle section of the hanger for insertion in an automated process. This adds to the expense of employing coil springs.

A further factor which adds to the expense of using coil springs lies in the manufacture of a hollow middle section. There are two principal ways in which this section can be made. The hollow inside can be formed around a core which is inserted longitudinally into the mould from one end of the middle section, or it can be made, as in UK patent application No. 2120542A, by a number of mould projections which are inserted from the sides of the hanger to form alternate openings to each side of the hanger, so that the openings join together to create a continuous channel down the middle. This latter method of manufacture is much cheaper than the former but is not very suitable for use with coil springs. This is because if a coil spring is inserted in the channel and compressed, the individual coils of the spring catch on the edges of the openings and the operation of the spring is uneven and noisy.

Apart from the cost of manufacturing hangers with coil springs, these hangers have other disadvantages. The extent to which such a hanger can be compressed is limited by the presence of the spring in the hollow middle section because, at its maximum compression, the spring still occupies a finite length of the channel. In practice, it is found that this limitation on the variation of width of the hanger means that more than one size of hanger needs to be made to accommodate the range of garment sizes normally required to be hung. If the range over which the hanger could be compressed was increased, then only one size of hanger would have to be used. This could cut down on manufacturing costs and moreover would be of benefit to the trader using the hanger, because he would not have to concern himself with the sizes of the garment and of the hanger.

While it has been proposed to use rubber bands in hangers, rather than coil springs, as in German Patent Application No. DE 3530380 Al and German Gebrauchsmuster No. 7620036, these hangers have not met with substantial commercial success.

SUMMARY OF THE INVENTION

According to the present invention, there is provided a garment hanger comprising a middle section with a hanging member mounted thereon and two end sections with means for engaging a garment, at least one of the end sections being arranged for sliding movement relative to the middle section between a retracted position and an extended position, and an elastomeric band which, when the said end section is in the retracted position, extends over a length greater than the length of overlap between the said end section and the middle section, but which is trained in such a path as to urge the said end section towards the extended position.

According to another aspect of the present invention, there is provided a garment hanger comprising a middle section with a hanging member mounted thereon and two end sections with means for engaging a garment, at least one of the end sections being arranged for sliding movement relative to the middle section, between a retracted position and an extended position, and an elastomeric band which urges said end section towards the extended position, the elastomeric band being trained in a path such that, as the end section is retracted, an increasing proportion of the material of the band extends between the end section and the middle section to urge those sections apart.

The middle section may be hollow, with the or each end section telescopically mounted within the middle section, or the or each end section may be hollow, with the middle section telescopically mounted therein.

The invention has the advantage of being able to expand and contract over such a great range, that a single hanger can be used to hang any garment within the normal range of sizes available. It also has the advantage of reducing creep in the elastomeric band. Elastomeric material undergoes creep when stretched and particularly when exposed to heat or ultra-violet light. The hanger of the present invention is intended to be used with the elastomeric band or bands in a stretched condition for long periods of time while garments are being hung for display. The reduction of creep is therefore a significant advantage, as otherwise it could lead to the tension in the band relaxing and the garment falling off the hanger.

Preferably the elastomeric band is made of natural rubber and preferably it is coated or impregnated with a lubricant such as a silicone. The band may be double-ended, and it may be formed such that the molecules of elastomer extend longitudinally along the band. It may be generally circular in cross-section, and may have a diameter of from about 2 mm to about 6 mm, but preferably from about 3 mm to about 4 mm. It will be appreciated, however, that the band may have other cross-sectional shapes, such as a generally rectangular section.

Preferably the elastomeric band is trained around a rounded guide, having a radius of curvature of between about 2 mm and 10 mm, and preferably between about 3 mm and 5 mm. There is preferably one such guide at each end of the middle section.

With the elastomeric band described above and the rounded guides described above, the friction between the band and the guides is kept low, so that the band is able to slide around the guides, thereby allowing the tension in the band to be distributed to some degree over its entire length. In this way, the maximum force exerted by the band on the end sections preferably does not exceed 2 kg, and more preferably lies in the approximate range of 0.75 kg to 1.5 kg. It is found that this range of forces holds the garment satisfactorily on the hanger, without causing buttons to come undone.

The band may pass along the underside of the middle section, between guides at the ends thereof and the middle section may have side walls which extend downwards to form flanges which flank the band, so as to conceal it when the hanger is viewed from the sides.

The middle section preferably has a generally rectangular hollow cross-section and has two walls which have alternating gaps and slots, so that the section can be moulded by means of mould elements which extend through the slots to mould the hollow interior.

Snap-fit retaining means may be provided to retain the end sections in the middle section.

BRIEF DESCRIPTION OF THE DRAWINGS

Preferred embodiments of the invention will now be described by way of example with reference to the accompanying drawings, as follows:

FIGS. 6*a* and 7*a* are perspective views of fifth and sixth arrangements of anchoring means, while

FIG. 9 is a sectional view of the hanger of FIG. 8 along the line A—A.

FIGS. 10*a* and 10*b* are cross sectional views of the hanger of FIGS. 8 and 9 along the lines B—B and C—C, respectively.

FIG. 11 is a side elevation of the end of end section 114 of FIG. 8.

DESCRIPTION OF THE PREFERRED EMBODIMENTS

Figure 1:
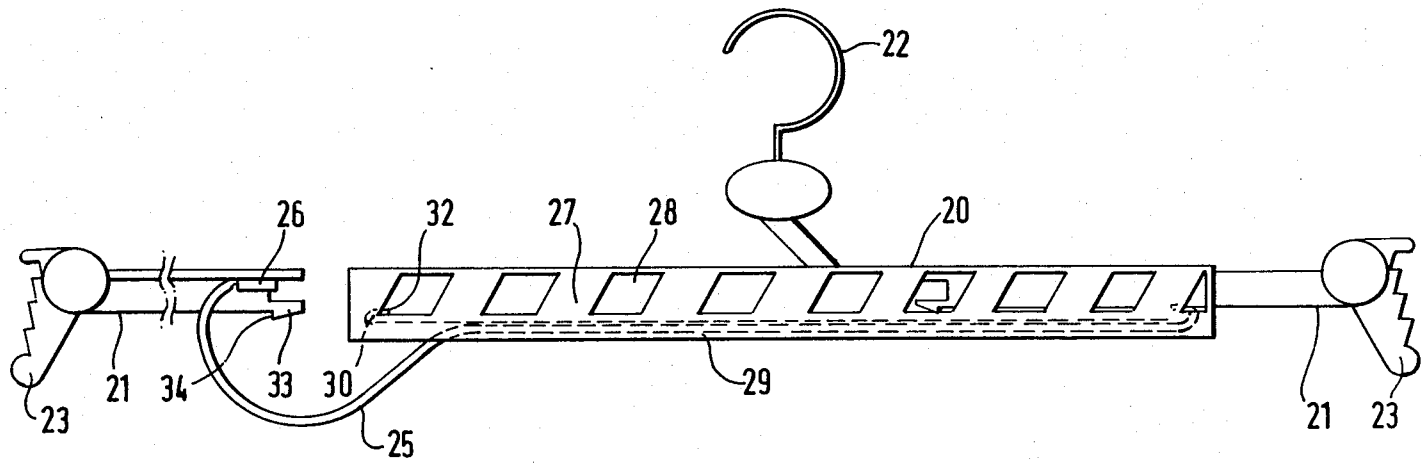
FIG. 1 shows a first embodiment of a hanger according to the invention in side elevation.

Referring to FIG. 1, the hanger comprises a middle section 20, two end sections 21 and a hanging member 22 mounted on the middle section 20. The hanging member is in the form of a hook, but a stud can be provided instead, for hanging from a slotted rail, or any other hanger member can be used. On the end of each end section, there is a member 23 designed to engage the inside of a garment, for example, at the waist band of a pair of trousers or a skirt.

The middle section 20 is hollow and the end sections 21 extend into the middle section in a telescopic manner. A rubber band 25 extends from the inward pointing end of one end section 21 to the inward pointing end of the other end section 21. Each end of the rubber band 25 is attached to its respective ends section 21 by anchoring means 26, to be described in more detail below.

The rubber band is made of natural rubber, which has been extruded in the direction along the length of the band, so that the molecules of the rubber lie longitudinally along the band. The band has circular cross section, having a thickness of 3 mm. The rubber is coated by immersion in silicone.

The middle section 20 has a box section formed of slats 27, with gaps 28 therebetween. The side walls formed by these slats 27 extend downwards in the form of two side flanges 29. At each end of the middle section, the floor of the box section (not shown) has a rounded end 30. The rounded end has a radius of 4 mm. Immediately inward of the rounded end 30, there is an inward facing step 32 formed in the floor of the box section. On the inward facing end of each end section 21, there is a tongue 33 projecting inwardly, having an abutment 34 pointing downwards.

In use, the two end sections are inserted into the hollow middle section, in a telescopic manner. The tongue 33 of each end section passes over the corresponding step 32 in the end of the middle section, causing the tongue 33 to bend resiliently upwards, until the abutment 34 passes over the step 32, thereby locking the end section 21 into the middle section 20. The rubber band 25 extends from its anchoring means 26 around the rounded edge 30 and between the flanges 29, passing along the length of the middle section 20, around the other rounded end 30 at the other end of the middle section 20, and from there to its anchoring means 26 on the opposite end section 21.

To mount a garment on a hanger, the members 23 mounted on the ends of the end sections 21 are pushed inwards. This action causes the elastic band 25 to stretch. The stretching of the elastic band 25 first occurs in the section of the band between the anchoring means 26 and the rounded end 30, at either end of the band. A point is reached at which the tension in the section of the band 25 which is stretched exceeds the friction between the band 25 and the rounded end 30 of the middle section. At this point, the band 25 slides around the rounded end 30, and is "paid out", so that an increasing proportion of the remaining section of the band gradually becomes stretched too. The consequence of this operation is that the tension in the band 25 is not able to increase to the same extent as would be the case if the band were not able to slide around the rounded end 30, but instead were permanently attached at a point at the end of the middle section 20. With the members 23 in this retracted position, those members are inserted on the inside of the waist band of a garment, such as a skirt or a pair of trousers, and they are released. The tension in the band 25 causes the end sections 21 to expand again, so that the members 23 grip the inside of the waist band of the garment.

The feature of "paying out" the band 25 means that the retraction/force characteristic of the hanger (that is to say the graph of the force exerted by the band on the end section, plotted against the degree of retraction of the end section) is non-linear. In fact, the force rises quickly initially and, on increased retraction of the end sections, the rate of rise of the force tails off. The force exerted on the end sections reaches a maximum of about 1.5 kg at full compression of the end sections. This retraction/force characteristic is found to be very suitable for garment hanging.

It is found, with the embodiment of the invention described above, that, because the rubber band stretches over a length which is greater than the length of overlap between the middle section and the end sections, the strain in the band is less, for a given displacement, than would be the case if a separate band was used at each end of the hanger, extending only between the end of the end section and the end of the middle section. Since creep is strain-dependent, this means that the creep is reduced.

Figure 2:
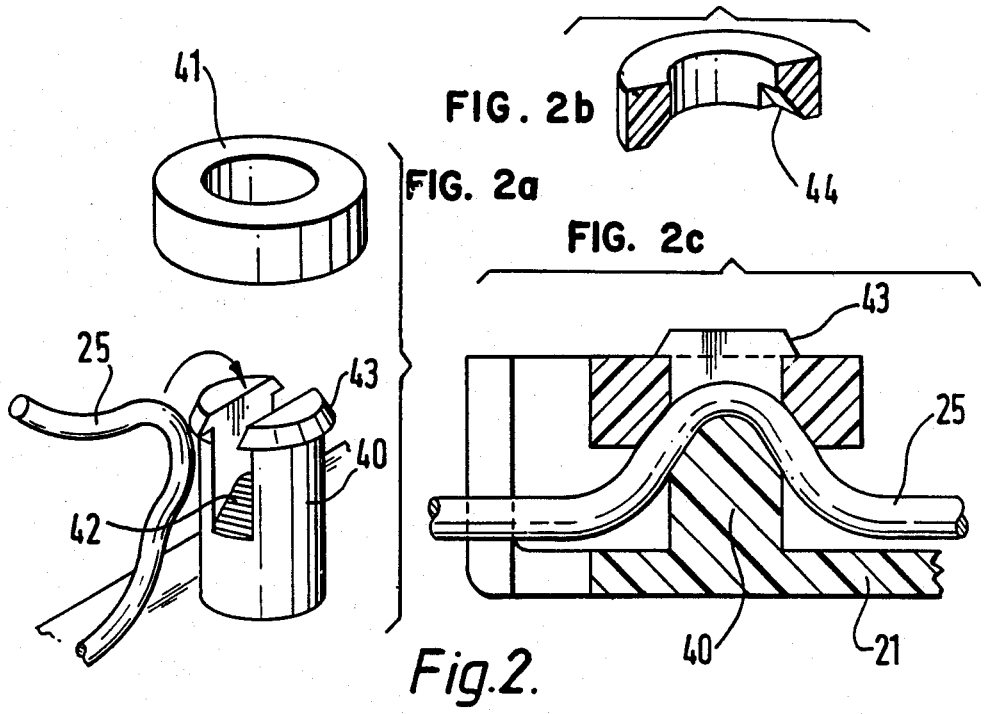
FIG. 2 shows a first arrangement of anchoring means for anchoring the end of the rubber band to the end section. The anchoring means are shown in exploded perspective view in FIG. 2*a*, a sectioned cap part is shown in perspective view in FIG. 2*b* and the anchoring means are shown assembled and in cross-section in FIG. 2*c*.

Referring now to FIG. 2, particular anchoring means 26 are shown for anchoring the end of the band 25 of the end section 21. The anchoring means comprise a pin 40, which is integrally moulded on the end section 21, and a cap part 41. The pin 40 has a central slot, with a serrated end wall 42, and has a lip 43 around its end. The cap part 41 is cylindrical and has a hole through its center. The cap has two diametrically opposite notches 44 on its underside, adjoining the hole.

The anchoring means is assembled by placing the band 25 in the slot in the pin 40 and press-fitting the cap part 41 over the pin 40. The band is pinched between the end wall 42 of the slot in the pin 40 and the notches 44 in the cap. The serrated end wall 42 grips the cord. The lip 43 holds the cap part 41 securely in place.

Figure 3:
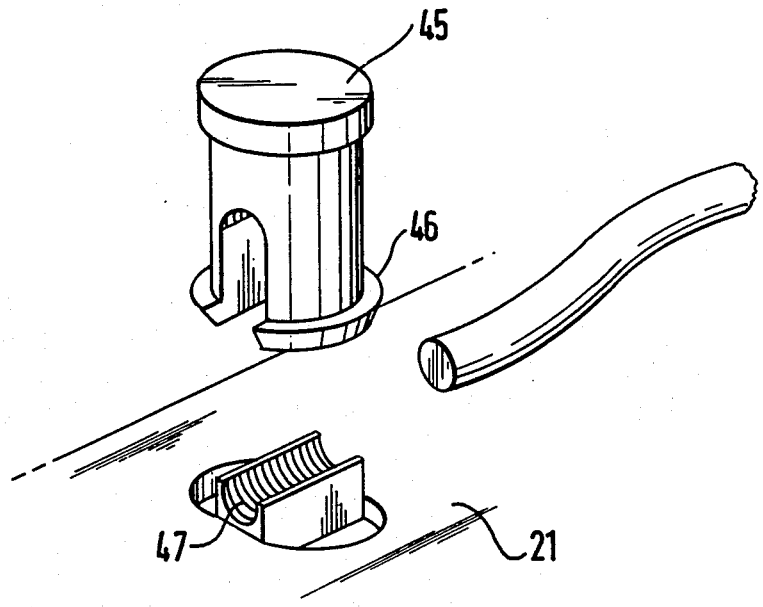
FIG. 3 shows a second, alternative arrangement of anchoring means.

FIG. 3 shows, in perspective view, an alternative pin-type anchoring means comprising a pin 45, having a central slot and a lip 46 surrounding the end of the pin adjacent the slot. In the end section 21, there is formed a gripping platform 47, having a trough-like groove with serrations across it. On either side of the platform 47, there is a segment of a hole, for receiving the parts of the pin 45 on either side of the slot. The anchoring means is assembled by placing the cord 25 across the platform 47 so that it lies in the trough-shaped groove, and press-fitting the pin 45 into the segment-shaped holes, so that the lip 46 passes through the holes to make a snap-fit. The band 25 is then gripped between the platform 47 and the end wall of the slot.

Figure 4A:
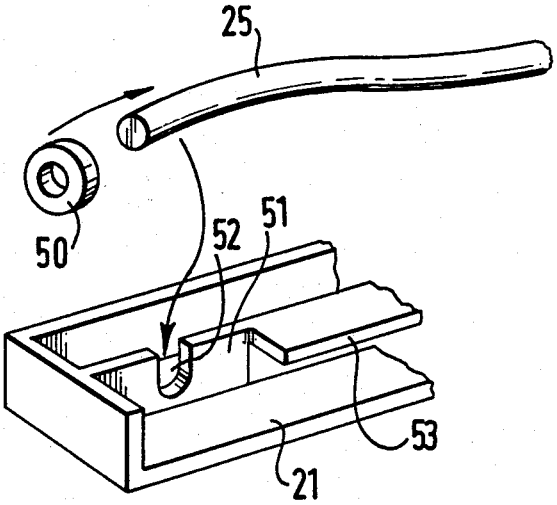
FIG. 4*a* shows a third arrangement of anchoring means and FIG. 4*b* shows a modification of the means shown in FIG. 4*a*.
Figure 4B:
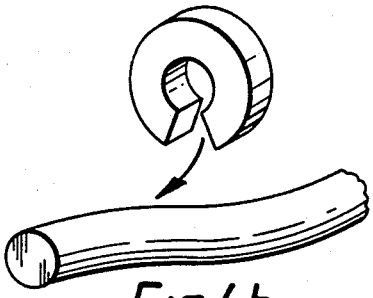

FIG. 4 shows an alternative method of anchoring the end of the band 25. A button 50 is secured on the end of the band 25 by adhesive. A longitudinal middle rib 51 is provided in the end section 21, with a slot 52 formed across the rib. The cord is simply inserted in the slot 52 and the button 50 is unable to pass through the slot 52, thereby holding the band 25 in position. A flange 53 is provided in a position to prevent dislodgement of the band 25 in the direction out of the slot 52. As shown in FIG. 4*b*, the button 50 can have a cut-out to facilitate insertion of the cord into the button.

Figure 5:
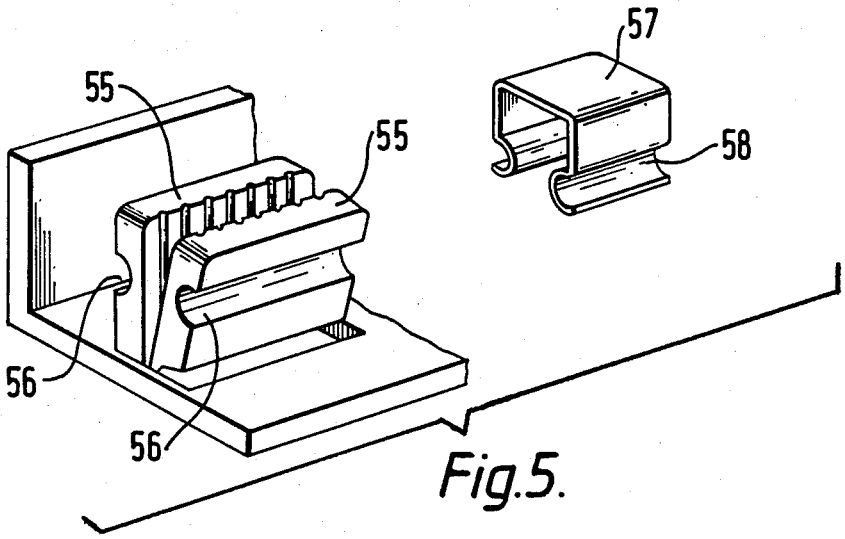
FIG. 5 shows a fourth arrangement of anchoring means.

Turning to FIG. 5, another two-piece anchoring means 26 is shown, comprising a pair of moulded flaps 55, forming a pair of jaws. The inward-facing surfaces of the flaps 55 are serrated. On the opposite face of each flap, there is a groove 56, formed across the flap. A clip 57 is provided, having two opposite, inward facing ribs 58. The band 25 is inserted in the jaws formed by the flaps 55, and the clip 57 is clipped over the flaps, so that the ribs 58 are located in the grooves 56. The clip 57 holds the flaps firmly together, so that they grip the band.

Figure 6A:
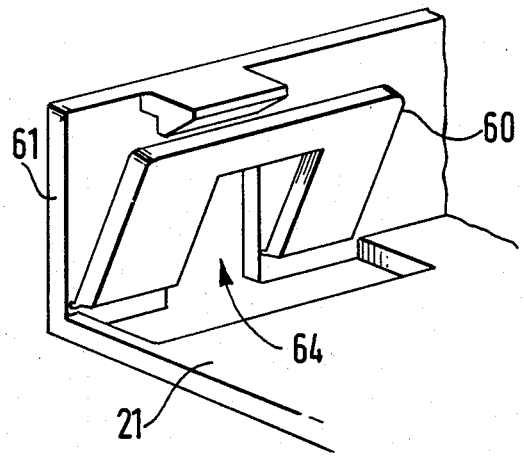
Figure 6B:
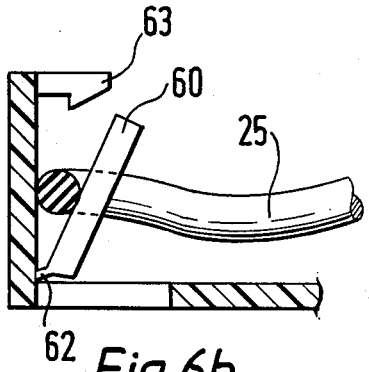
FIGS. 6*b* and 7*b* are cross-sections of those arrangements respectively.

Referring to FIG. 6, a one-piece anchoring means is shown, having a single flap 60 integrally moulded to the end piece 21, adjacent a wall 61 of the end piece. The flap 60 is connected to the end section 21 by a thin flexible web 62. Near the edge of the flap, remote from the web 62, there is formed in the wall 61 a hook 63. The band 25 is anchored by placing it between the flap 60 and the wall 61 and pressing the flap against the wall, until the edge of the flap passes under the hook 63, and is, held thereby. In order to facilitate the moulding of the mounting means, there is a shut-off, 64 corresponding to the flap 60 and the hook 63, which allows the moulding tool access to the flap and hook.

Figure 7A:
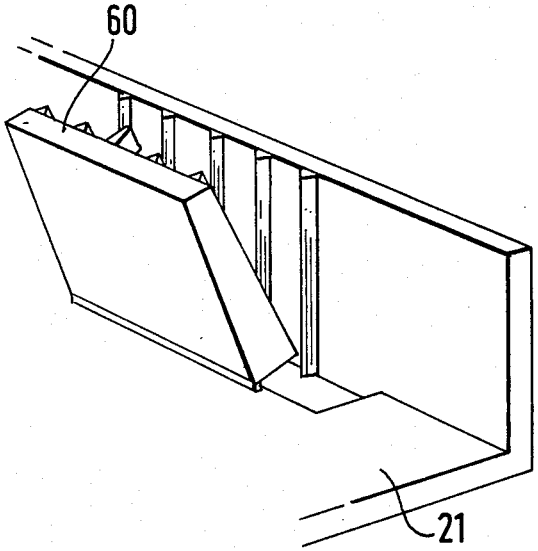
Figure 7B:
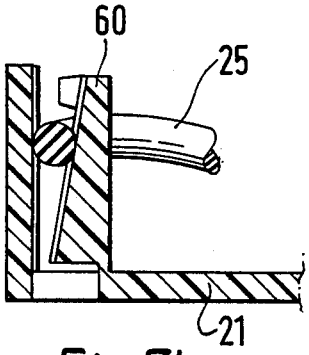
Figure 8:
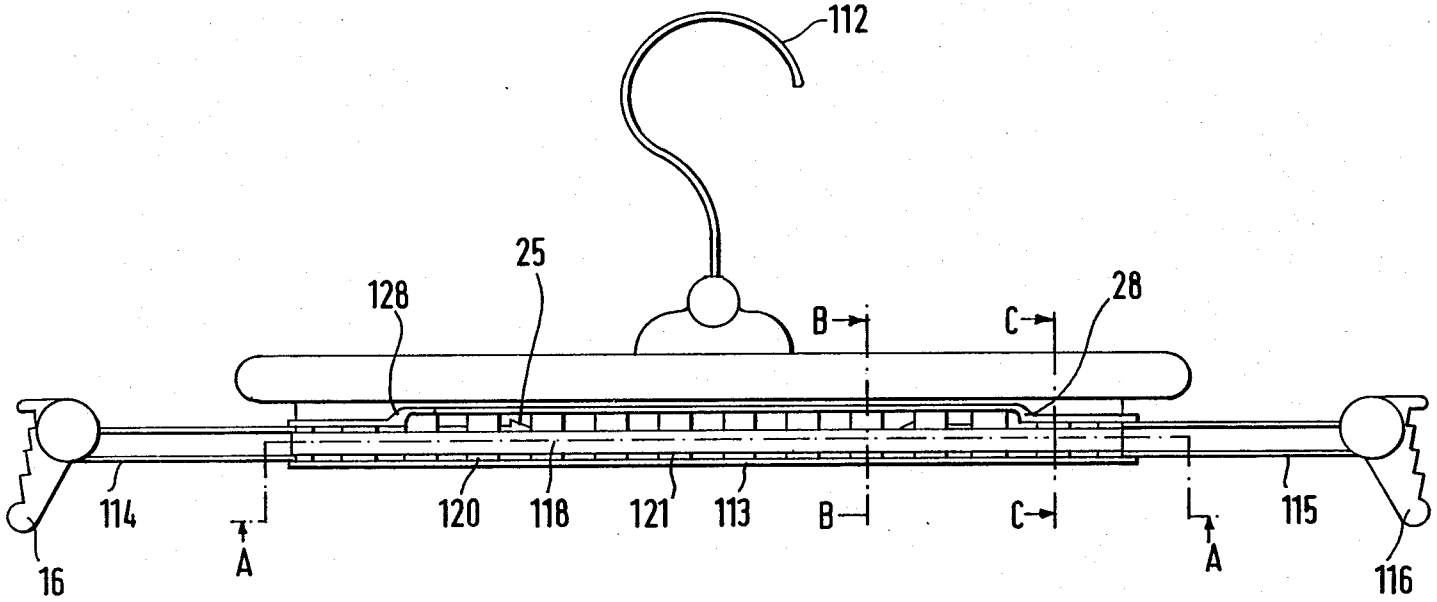
FIG. 8 is a side elevation of a second embodiment of a hanger according to the invention.

FIG. 7 shows anchoring means similar to those of FIG. 6, but instead of having a hook 63, the edge of the flap 60, remote from the web 62, is shaped so as to contact the side wall 61, when the band 25 is squeezed in position. The edge of the flap 60 is then welded to the side wall 61, by ultrasonic welding. The opposing faces of the flap 60 and the wall 61 are serrated.

The mounting means of FIGS. 6 and 7 have the advantage of requiring only a single moulded piece. This substantially reduces the cost of manufacture of the hanger.

Referring to FIGS. 8 to 11, a hanger is shown according to an alternative embodiment of the invention. The hanger comprises a middle section 113 and two end sections 114 and 115. Mounted on the middle section is a hanging member in the form of a hook 112. On each end section, there is a member 116 designed to engage the inside of a garment, for example at the waistband of a pair of trousers or a skirt.

The middle section 113 is hollow and the end sections 114 and 115 extend into the middle section in a telescopic manner, best seen in FIG. 9. A rubber band 118 or other elastomeric band extends along opposite longitudinal sides of the middle section 113 and protrudes into the middle section in the form of loops 118' at either end thereof. These loops pass around the ends of the end sections 114, 115 where they extend into the middle section 113. The band 118 can be coated with a silica-based coating to allow it to slide more freely around the end of middle section 113.

The middle section 113 has slats 120 with gaps 121 therebetween. Each slat 120 is positioned opposite a gap 121 on the opposite side of the hanger. These gaps provide a two-fold advantage: they enable the middle section 113 to be hollowed out during moulding by use of mould elements which approach from the sides, and they reduce the overall weight of the hanger and the amount of plastic required to make it.

From FIG. 11, it can be seen that the end of the end section 114 has a pair of fingers 125 and 126 extending longitudinally therefrom. The upper finger 125 has a barb-like profile providing an outward facing abutment 127. From FIG. 8, it can be seen that the hollow channel along the inside of middle section 113 has a smaller height over a short length at the ends, than in the center. This means that an edge 128 is provided at each end, where the channel changes from the greater height to the lesser height.

The hanger is assembled as follows. The elastic band 118 is first stretched around the slats 120 forming the middle section 113. One end section 114 is inserted into the end of the middle section so that the elastic band 118 locates itself between the fingers 125 and 126. As the end section 114 is inserted, finger 125 bends resiliently downwards until the abutment 127 passes over the edge 128, whereupon the finger springs upwards and the section 114 is locked against removal. The other end 115 is inserted in the same manner. Numerous other ways of securing the end sections within the middle section can be employed.

The hanger is used by compressing the end sections towards each other, inserting the hanger into the waistband of a garment, e.g. a skirt, and releasing the end sections, allowing them to spring apart, so that the members 116 engage the inside of the waistband, whereupon the skirt will stay suspended when the hanger is hung up.

It is found, with the embodiment of the invention described above, that, because the elastic band stretches all the way around the middle section 113 and therefore stretches over a long length, the strain in the band is less, for a given displacement, than would be the case if two separate bands were used, one at either end. Since creep is strain-dependent, this means that the creep is reduced.

A longitudinal recess (not shown) may be formed in each side wall of the hanger to receive the length of elastomeric band that extends from one end of the middle section to the other on each side, and/or vertical side flanges may be provided to cover those lengths of the band and hide them from view when viewed from the side.

Because there is no compression spring inside the middle section of either of the hangers described, the end sections can in each case be compressed until their ends meet inside the hanger. Indeed, their ends could even be made to overlap. This allows for a great variation in size of garments that can be hung.

Hangers according to the invention have the following additional advantage in their ease of manufacture. Elastic bands can be made one-by-one by cutting them off a continuous tube of elastic. A pair of fingers is inserted into the tube and spread apart, pulling the elastic taut. A short length of the tube is cut off the end and this provides the band. This band is also held by fingers and these are used to transfer the band to the hanger. By this means, the process can be easily automated and it is much better than a process which involves handling loose springs or loose bands. Flat bands with anchoring means in the form of end-toggles can be made in a similar way.

It will, of course, be understood that the above description has been given by way of example only and modifications of detail can be made within the scope of the invention.

I claim:

1. A garment hanger comprising:

a middle section with a hanging member mounted thereon;

two end sections with means for engaging a garment, at least one of the end sections being arranged for sliding telescopic movement relative to the middle section, between a retracted position and an extended position;

a single elastomeric band arranged to urge said slidable end section towards the extended position, a section of said elastomeric band extending from the vicinity of the end of the end section to the vicinity of the end of the middle section and back along the middle section towards the middle thereof; and guide means around which the elastomeric band is guided in a non-linear path such that, as the end section is retracted, the material of the band slidingly moves around the guide means, along the length of the band, so that an increasing proportion of the material of the band extends between the one section and the middle section, thereby reducing the rate of increase of tension force to said end section towards the extended position.

2. A hanger according to claim 1 having a similar telescopic end section at each end of the middle section, wherein the band is similarly disposed in respect of each end section, extending continuously between the end sections and the section of band between the end sections passes underneath the middle section and is flanked on either side by flanges on the middle section.

3. A hanger according to claim 1 wherein the band is a double-ended band and anchoring means are provided for anchoring each end to an end section.

4. A hanger according to claim 1 wherein the elastomeric band is a rubber band which has been extruded longitudinally.

5. A hanger according to claim 4 wherein the rubber band has been treated with silicone to reduce its surface friction.

6. A hanger according to claim 1 wherein the elastomeric band provides an outward force between said at least one sliding end section of between 0.75 Kg and about 1.5 Kg over at least a major proportion of the range of movement of said at least one sliding end section.

7. A hanger according to claim 1 wherein the middle section is hollow, with said at least one sliding end section being telescopically mounted within the middle section.

8. A hanger according to claim 7 wherein the middle section comprises alternate slats and gaps along its length, along both sides, whereby each slat is positioned opposite a gap on the opposite side of the hanger.

9. A hanger according to claim 1 wherein said guide means is mounted on said middle section.

10. A hanger according to claim 1 wherein said guide means is mounted on at least one of said end sections.

* * * * *